US006210225B1

(12) United States Patent
Cai et al.

(10) Patent No.: US 6,210,225 B1
(45) Date of Patent: Apr. 3, 2001

(54) ELECTRICAL CONNECTOR WITH A PICK-UP COVER

(75) Inventors: Shemin Cai; Shaoping Du, both of Kun-San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/458,590

(22) Filed: Dec. 9, 1999

(30) Foreign Application Priority Data

Nov. 11, 1999 (TW) ..... 88219280

(51) Int. Cl.[7] ..... H01R 9/16
(52) U.S. Cl. ..... 439/607; 439/79
(58) Field of Search ..... 439/607, 609, 439/79

(56) References Cited

U.S. PATENT DOCUMENTS 5,865,645 * 2/1999 Embo et al. ..... 439/607 X
5,984,727 * 11/1999 Wu et al. ..... 439/607
6,083,046 * 7/2000 Wu et al. ..... 439/607

* cited by examiner

*Primary Examiner*—Renee Luebke
(74) *Attorney, Agent, or Firm*—Wei Te Chung

(57) ABSTRACT

An electrical connector (1) comprises an elongate insulative housing (3) including a projection (30) projecting forwardly from the insulative housing, a plurality of terminals (52) received in grooves (300) defined in the elongate housing, a conductive shell (2) covering the projection of the insulative housing, and a conductive pick-up cover (6) engaging with a top of the insulative housing. A rivet (8) is used to secure a board lock (7) to the housing. The board lock has a leg (73) for insertion into a printed circuit board thereby securing the connector to the printed circuit board. The top of the insulative housing defines at least a positioning hole (32) with an inclined face (35). The pick-up cover includes a flat plate (60) with a pair of latches (62) extending downward for mounting on the top of the insulative housing and at least a positioning ridge also extending downward from the pick-up cover for engaging with the at least one positioning hole of the insulative housing. The flat plate of the pick-up cover provides a flat pick-up face for attachment of a vacuum pick-up device.

9 Claims, 3 Drawing Sheets

ELECTRICAL CONNECTOR WITH A PICK-UP COVER

BACKGROUND OF THE INVENTION

The present invention relates to a connector, and particularly to an electrical connector with a pick-up cover for facilitating assembly and protecting the circuit therein.

U.S. Pat. No. 5,692,912 discloses an electrical connector. The electrical connector comprises an elongated dielectric housing having a plurality of terminals, and an elongated tail aligning device for protecting the terminals during mounting on a printed circuit board. This connector has a small fixing base surface, so it is not adapted to use with automatic placement device for fixing on a printed circuit board. The connector also lacks EMI shielding, so protection of connected circuits is limited.

Other similar connectors, such as that disclosed in U.S. Pat. No. 5,591,036, disclose an electrical connector including an elongated housing and a terminal cover provided to secure the connection between the connector and a printed circuit board, but the connector fails to provide a fixing base plate to solve the assembly problem. Therefore, an improved electrical connector is required to overcome the disadvantages of the prior art.

BRIEF SUMMARY OF THE INVENTION

A first object of the present invention is to provide an electrical connector with a pick-up cover which provides EMI protection for the connector;

A second object of the present invention is to provide an electrical connector with a pick-up cover on the insulative housing, where the pick-up cover defines a base surface for attaching automatic assembly devices, thereby facilitating assembly.

Accordingly, an electrical connector in accordance with the present invention comprises an elongate insulative housing including a projection projecting forwardly from the insulative housing, a plurality of terminals received in the corresponding grooves located in the elongate housing, a shell covering the projection of the insulative housing, a pick-up cover engaging with a top of the insulative housing, a spacer, and an attaching means to secure the shell to the housing and the connector to the printed circuit board. An upper surface is disposed on the top of the insulative housing and defines at least a positioning hole with an inclined face. The pick-up cover comprises a flat plate with a pair of latches extending downward for mounting on the upper surface of the insulative housing.

Moreover, several positioning ridges downwardly extending from the flat plate for receipt in several corresponding positioning holes of said insulative housing, and a positioning bar downwardly extending from the flat plate of the pick-up cover between the latches thereof cooperate with the latches to retain said pick-up cover on the electrical connector.

Other objects, advantages and novel features of the invention will become more apparent from the following detailed description of the present embodiment when taken in conjunction with the accompanying drawings.

DETAILED DESCRIPTION OF THE INVENTION

Figure 1:
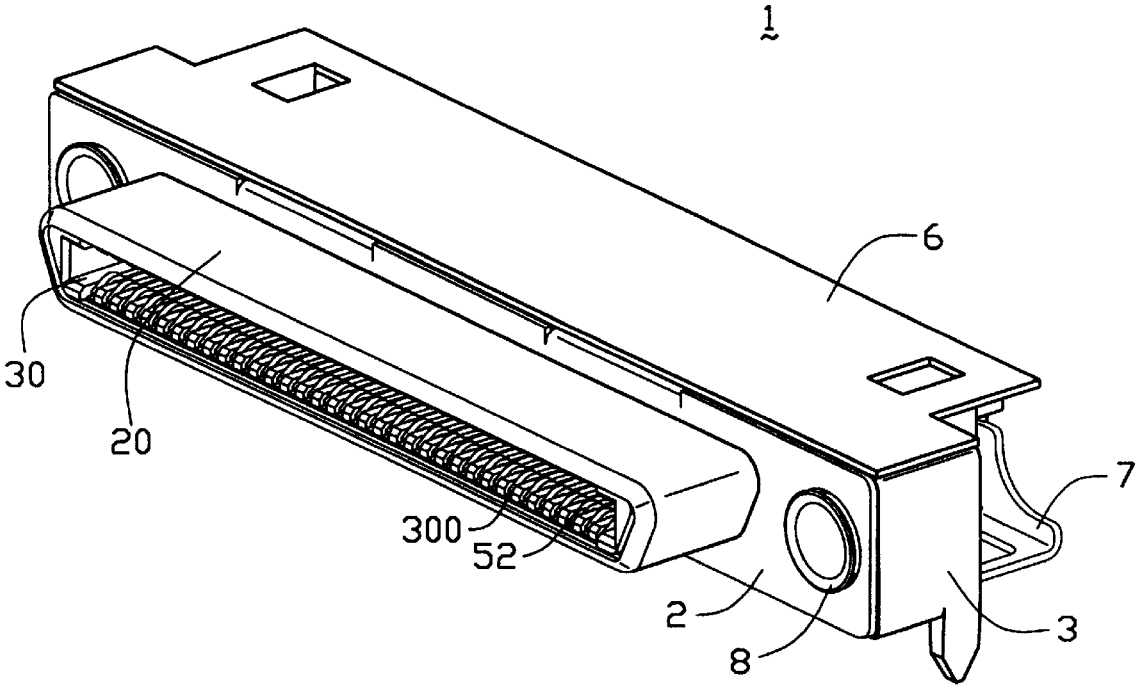
FIG. 1 is an assembled view of an electrical connector in accordance with the present invention.
Figure 2:
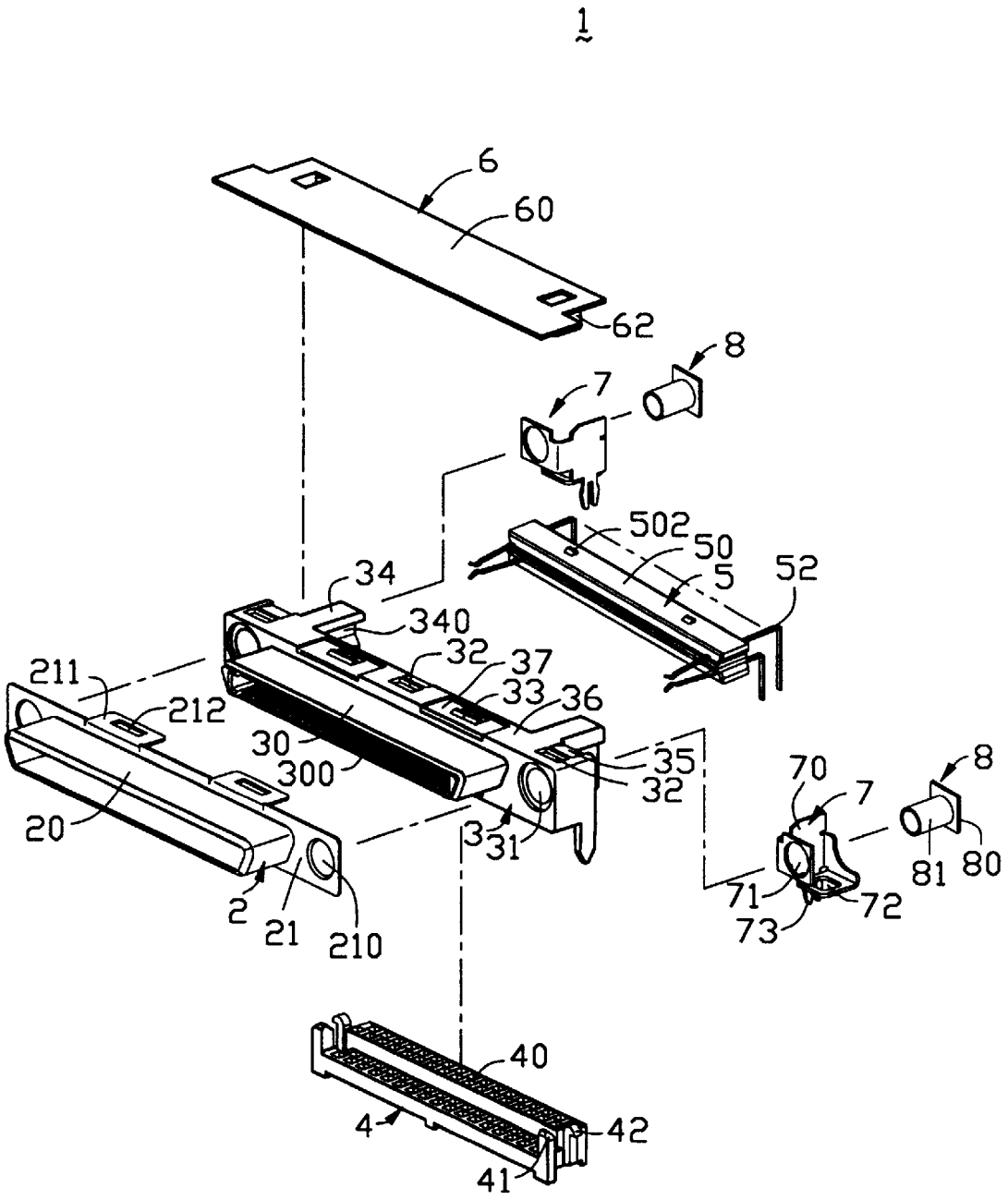
FIG. 2 is an exploded view of an electrical connector in accordance with the present invention.

Referring to FIGS. 1–2, an electrical connector 1 in accordance with the present invention comprises an elongate pick-up cover 6, an elongate insulative housing 3, a shell 2, a terminal module 5, a spacer 4, a pair of board locks 7 and a pair of rivets 8.

The insulative housing 3 includes a projection 30 projecting forwardly thereof and defining a plurality of grooves 300 in an inside surface thereof for receiving a corresponding number of terminals 52. An upper surface 36 is disposed on the top of the insulative housing 3 and defines several positioning holes 32 and recesses 37, each recess 37 further forming a corresponding tab 33 therein. A guiding inclined face 35 is defined to a rear of each positioning hole 32. A pair of guiding arms 34 extend perpendicularly and rearwardly from a rear side (not shown) of the insulative housing 3 along the engaging direction and include a guiding slot 340 defined in an inward-facing surface thereof for guiding terminal module 5 therebetween. A pair of through-holes 31 extend through opposite ends of the insulative housing 3.

The terminal module 5 includes an insulative block 50 forming several protrusions 502 on top and bottom faces thereof for engaging with the insulative housing 3. A plurality of conductive terminals 52 is insert molded into the block 50.

The insulative spacer 4 is an elongate step-shape structure defining a plurality of passageways 40 for receiving the lower portions of the plurality of terminals 52 therein. A pair of guiding posts 41 and catches 42 are formed on opposite ends of the spacer 4 for cooperating with the guiding arms 34 of the insulative housing 3.

The conductive shell 2 covers a front end (not labelled) of the insulative housing 3 and comprises an elongate panel 21 from which a shroud 20 forwardly projects. A pair of locking holes 210 is defined at opposite ends of the panel 21. A pair of locking plates 211 rearwardly extends from a top edge of the panel 21, each locking plate 211 further defining a hole 212 for engaging with the tab 33 of the insulative housing 3.

Attention is directed to FIG. 2. A pair of metallic board locks 7 and rivets 8 are mounted at either end of the electrical connector 1. Each board lock 7 includes a main body 70, a hole 71, an aperture 72 and a leg 73, each extending from the main body 70. The leg 73 can be inserted into the printed circuit board for retaining the electrical connector thereon. Each metallic rivet 8 comprises a base plate 80 from which a tube 81 extends.

Figure 3:
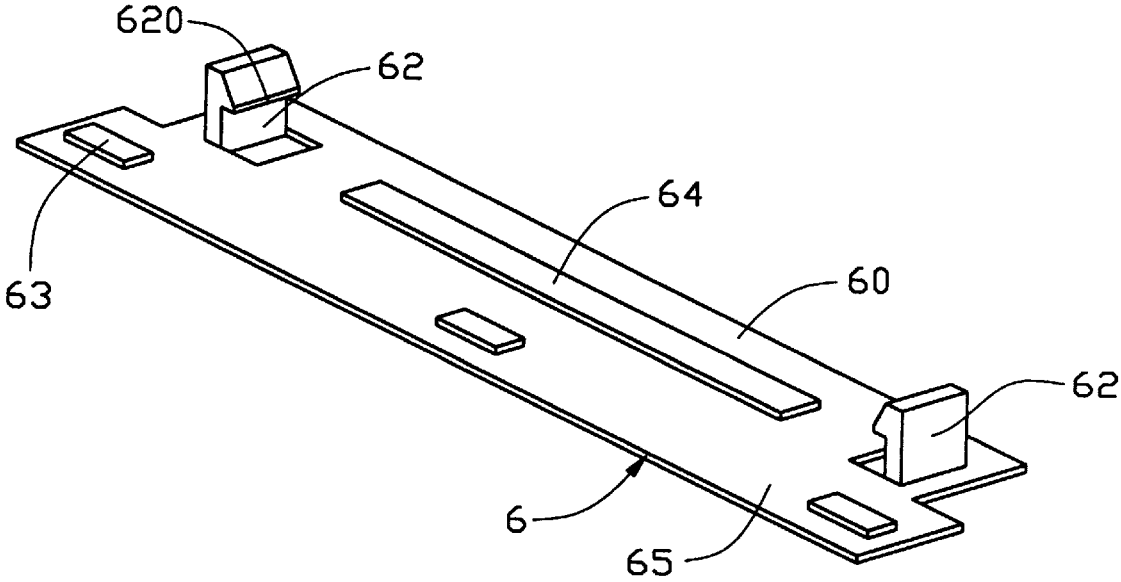
FIG. 3 is a perspective view of the bottom of the pick-up cover of an electrical connector in accordance with the present invention.

Also referring to FIGS. 2 and 3, the conductive pick-up cover 6 comprises a flat plate 60 with an upper side (not labelled) and a lower side 65, a pair of latches 62 extending downward from the lower side. Several positioning ridges 63 are formed on a forward portion of the lower side 65 and a positioning bar 64 is formed on a rearward portion of the lower side 65 between the latches 62. A clipping portion 620 is formed at a distal end of the latches 62.

Referring to FIGS. 2 and 3, the terminal module 5 is inserted into the rear side (not shown) of the housing 3 via the guiding slots 340, a forward portion of the terminals 52 engaging with the grooves 300. The spacer 4 is fitted between the guiding arms 34 of the housing, its passageway 40 guiding lower portions of the terminals 52. The shell 2 is fitted to the front end (not labelled) of the housing 3, the holes 212 of the shell 2 engaging with the tabs 33 of the housing 3. Board locks 7 are positioned in cavities (not shown) at opposite ends of the rear side (not shown) of the housing 3. The tube 81 of each rivet is inserted sequentially through corresponding holes 71 of the board locks 7, through-holes 31 of the housing 3, and locking holes 210 of the shell 2, and is then flattered to rivet the board locks 7, housing 3, and shell 2 together. Finally, the flat plate 60 is fitted to the upper surface 36 of the housing 3, the clipping portion 620 of the latches 62 of the flat plate 60 sliding from the rear of an outer side of the guiding aims 34 toward the rear side (not shown) of the housing 3, the positioning ridges 63 on the lower side 65 sliding up the inclined faces 35 of the upper surface 36 of the housing 3 and snappingly engaging with the positioning holes 32 in the upper surface 36, the positioning bar 64 engaging with upper inside edges of the guiding arms 34 and the rear side (not shown) of the housing 3. The conductive pick-up cover 6 is thus retained on the housing 3. It is to be understood that the conductive flat plate 60 provides further EMI shielding to the terminals 52, and also provides a flat pick-up surface (fixing base surface) for attachment of vacuum pick-up devices. This makes the electrical connector easy to use with automatic assembly systems, increasing assembly efficiency for correction onto circuit boards and lowering cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having an upper surface and a pair of guiding arms extending rearwardly;

a plurality of terminals received in the insulative housing;

a shell covering the insulative housing; and a pick-up cover having a flat plate placed on said upper surface of the insulative housing and a pair of downwardly extending latches releasably engaging the guiding arms of said insulative housing.

2. The electrical connector as claimed in claim 1, wherein said insulative housing has at least one positioning hole on said upper surface, and wherein the pick-up cover has a corresponding number of positioning ridges downwardly extending from the flat plate for engaging with the at least one positioning hole to locate the pick-up cover on the insulative housing.

3. The electrical connector as claimed in claim 2, wherein a corresponding number of inclined faces are formed rearwardly of the at least one positioning hole and terminate at a rear surface of the insulative housing for guiding the pick-up cover.

4. The electrical connector as claimed in claim 2, wherein the pick-up cover comprises a positioning bar extending downwardly from the flat plate between the latches for fitting between said guiding arms and a rear side of the electrical connector.

5. The electrical connector as claimed in claim 4, wherein the shell includes a pair of locking plates extending rearward, and the upper surface of the insulative housing defines a pair of recesses each forming a tab for engaging with the locking plate, the locking plates being positioned within the recesses at a level substantially below the upper surface of the insulative housing.

6. The electrical connector as claimed in claim 1, further comprising a block received in the insulative housing, and wherein the plurality of terminals is insert molded with the block.

7. The electrical connector as claimed in claim 1, wherein a board lock and a rivet are provided to secure the shell to the insulative housing.

8. The electrical connector as claimed in claim 1, further comprising a spacer mounted to and between the guiding arms of the insulative housing for positioning the terminals.

9. An electrical connector comprising:

an insulative housing defining an upper surface, a projection extending forward from a central portion thereof and a pair of guiding arms extending rearward at two opposite ends thereof;

a plurality of terminals received within the housing with tail portions positioned between said pair of guiding arms;

a shell covering said projection;

a pick-up cover defining a flat plate detachably attached to the upper surface for use with a vacuum device, said flat plate further extending rearward and covering said tail portions of the terminals in a vertical direction for EMI shielding; wherein said pick-up cover includes a pair of latches latchably engaged with said pair of guiding arms for attachment of the pick-up cover onto the upper surface of the housing, and said pick-up cover is adapted to be removed from the housing after the connector is mounted to a printed circuit board.

* * * * *